United States Patent [19]

Takahashi

[11] 4,377,019

[45] Mar. 22, 1983

[54] RESILIENT HINGE WITH COIL SPRING ON PINTLE

[75] Inventor: Jun Takahashi, Aikawa, Japan

[73] Assignee: NHK Spring Co., Ltd., Yokohama, Japan

[21] Appl. No.: 277,283

[22] Filed: Jun. 25, 1981

[30] Foreign Application Priority Data

Jun. 25, 1980 [JP] Japan ..... 55-86206

[51] Int. Cl.[3] ..... E05F 1/12

[52] U.S. Cl. ..... 16/307; 16/375

[58] Field of Search ..... 16/307, 298, 375, 306

[56] References Cited

U.S. PATENT DOCUMENTS

| | | | |
|---|---|---|---|
| 2,025,238 | 12/1935 | Harter | 16/307 X |
| 2,309,279 | 1/1943 | Smythe | 16/307 X |
| 2,703,430 | 3/1955 | Thomas et al. | 16/298 |
| 2,853,924 | 9/1958 | Herzfeld et al. | 16/307 X |

FOREIGN PATENT DOCUMENTS

| | | | |
|---|---|---|---|
| 362528 | 12/1931 | United Kingdom | 16/307 |

*Primary Examiner*—Werner H. Schroeder
*Assistant Examiner*—Andrew M. Falik
*Attorney, Agent, or Firm*—Fleit & Jacobson

[57] ABSTRACT

A hinge device used with a rotation member having a rotational moment which varies in accordance with a rotation angle. The hinge device comprises a core bar inserted into a fixed member, a flat wire torsion spring fixed at its ends to the core bar and to the rotation members, respectively, a lever memer fixed to a portion of the core bar, and a first flat spring biasing the rotation of the core bar in a certain direction and having its ends abutting the fixed member and the rotation member. A second flat member is provided to operate against the spring torque of the flat wire torsion spring having its ends abutting the fixed member and the rotation member.

2 Claims, 8 Drawing Figures

RESILIENT HINGE WITH COIL SPRING ON PINTLE

BACKGROUND OF THE INVENTION

This invention relates to a hinge device of a rotation member, for example, a lid body having a heavy weight such as on an office machine, especially a duplicator or the like, wherein the moment of rotation varies in accordance with a rotation angle. In such a lid body having a heavy weight such as several kgs, a great force is necessary for opening and closing. As a result, an accident such as catching a workman's finger in the lid body can occur during opening or closing of the lid body due to the inertia of the lid body. There has been a lengthy effort to solve this problem in this field.

BRIEF SUMMARY OF THE INVENTION

The object of this invention is to provide a novel hinge device with which it is possible for one to operate a rotation member with a small force, and also to be able to stop the rotation member at an arbitrary rotation angle. Another object is that the whole device be of a small size by approximating the composite spring characteristics of a flat wire torsion spring and a first and a second flat spring secured to a supporting portion of the rotation member and responsive to the change of moment of rotation caused by the rotation angle of said rotation member. The features and other objects of this invention will be more apparent by referring to the drawings as follows.

DETAILED DESCRIPTION OF THE INVENTION

Figure 1:
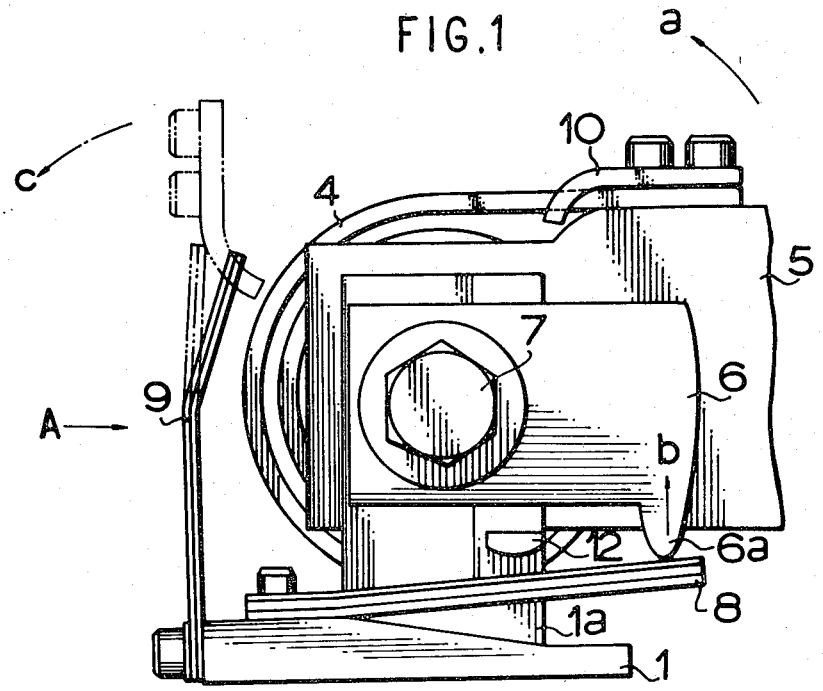
FIG. 1 is a side view of an example in a closed status of the hinge device according to this invention.
Figure 2:
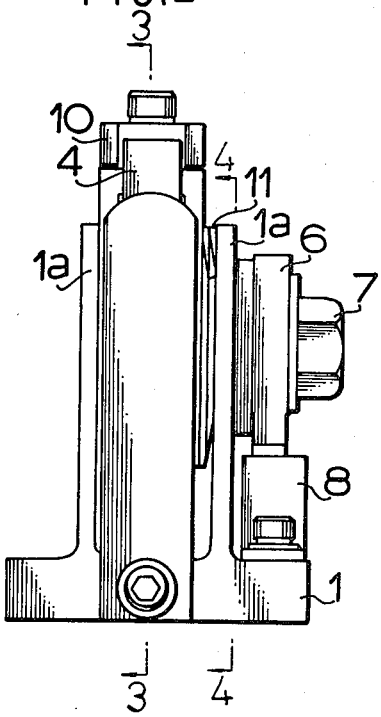
FIG. 2 is a perspective view from A shown by an arrow in FIG. 1.
Figure 3:
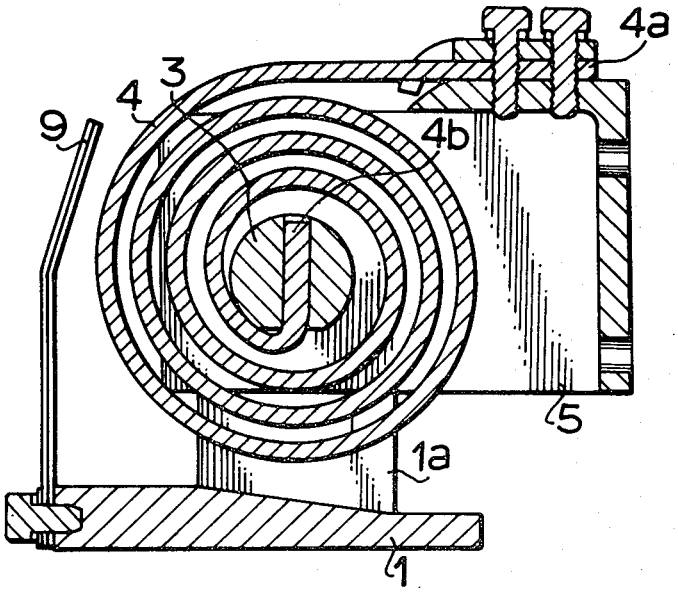
FIG. 3 and FIG. 4 are sectional views taken along lines 3—3 of FIG. 2 and line 4—4 of FIG. 2, respectively.

In FIG. 1, FIG. 2, and FIG. 3, erected plates 1*a* and 1*a* are mounted vertically and integrally on a fixed member 1 which fixes a body to a duplicator side, and further a projection 12 for presetting a flat spring 8 is formed thereon. A perforated hole 2 having a non-circular shape with point symmetry is provided on said erected plates 1*a* and 1*a*, and a core bar 3 is inserted into said perforated hole having a degree of rotation freedom. (See FIG. 4)

Figure 5A:
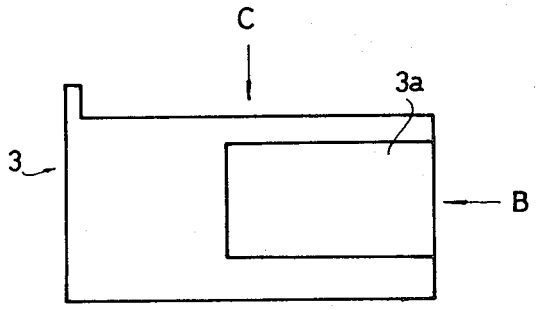
FIG. 5 shows a core bar, wherein (a) is a side view thereof, (b) is a perspective view from B shown by an arrow in (a), and (c) is a top view from arrow c in (a).
Figure 5B:
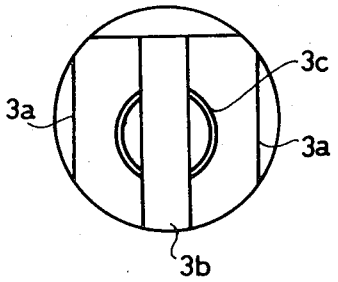
Figure 5C:
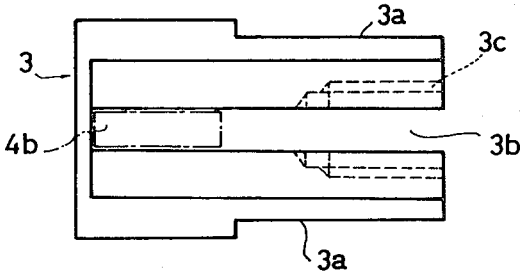

The core bar 3 is formed with a dividing groove 3*b* in parallel to a pair of bevelled portions 3*a* and 3*a* at both end portions thereof as shown in (a), (b) and (c) of FIG. 5, said dividing groove 3*b* being provided with a screw portion 3*c* at the outer end thereof. Accordingly, the degree of freedom of rotation 2 of the core bar 3 is determined by the bevelled portions 3*a* and 3*a* of the core bar and the hole wall of the perforated hole 2. The numeral 5 is a fitted member of a lid body pivotably secured to the core bar 3, hereafter called a lid body or a flat member of a lid body secured to the core bar 3. FIG. 1 shows the status of the closing terminal point (horizontal state) of a fitted member of the lid body 5, said fitted member of the lid body 5 opening in a direction shown by an arrow a. In this example, there exists an opening terminal point in a vertical state. The numeral 4 is a flat wire torsion spring secured at the outer end 4*a* thereof to the lid body 5 and the inner end 4*b* thereof to the dividing groove 3*b* of the core bar 3, respectively, so that said lid body 5 can in the free state be in a position where said body 5 slightly inclines in the c direction rather than in an erected state (a dot-dash line) in FIG. 1. The numeral 6 is a lever member wherein a contact terminal is allowed to abut to one end of the first flat spring 8 and is affixed with a bolt 7 screwed within screw portions 3*c* of the outer end of the core bar 3, thereby urging the lever member 6 in the direction b shown by an arrow. The numeral 9 is a second flat spring erected on the fixed member 1, said lid body 5 being adapted to abut said spring at the opening terminal point of the lid body 5 by means of a distance piece 10 fixed to the lid body 5.

In the hinge device constructed as mentioned above, for instance in FIG. 6, in representing the moment with respect to the rotation angle of the lid body 5 as M (solid line) and the spring torque of the flat wire torsion spring 4 as S (dash-dotted line), the moment M of the lid body 5 and the spring torque S of the flat wire torsion spring 4 can be allowed to approximately equal each other in the intermediate area, or Y area, of the range of the opening or closing operation of the lid body. Accordingly, in consideration of various kinds of friction caused by the rotation of the lid body 5, it is possible to stop the lid body 5 at an arbitrary rotation angle, and it is also possible to rotate the lid body 5 with a small operating force. However, in around the closing terminal point (X area) and the opening terminal point (Z area) of the lid body 5, the spring torque S of the flat wire torsion spring 4 is far larger than the moment M of the lid body 5. As a result, the lid body 5 is not stable in the X and Z areas, but rises up at the closing point with the aid of the spring torque S and is urged towards the opening direction at the closing terminal point. In this connection, the example of this invention has succeeded in approximating the change of the moment in the lid body 5 to the spring characteristics within the range of the whole operation of the lid body 5 with the aid of the composite functions of the flat wire torsion spring 4 wherein the first flat spring 8 and the second flat spring 9 are designed so that the force toward the c direction of the lid body 5, with the aid of the spring torque of the flat wire torsion spring 4, may be decreased when the distance piece 10 fixed to the lid body 5 abuts the flat spring 9 in said Z area. The second flat spring 9 as shown with a dash and dotted line in the Z area of FIG. 6, and the spring characteristic $S_1$ shown with a dash and two dotted line in FIG. 6 can be obtained. As a result, the spring characteristic in the Z area can be approximated to the moment change M of the lid body 5. In other words, the second flat spring 9 does not act on the lid body 5, flat wire torsion spring 4 and the core bar 3 as far as the lid body 5 rotates within the X and Y areas of FIG. 6, but abuts the distance piece 10 for the first time when the lid body 5 rotates within the Z area. Further, when the lid body 5 rotates in the C direction pressing the top end of the second flat spring 9 by means of the force of the flat wire torsion spring 4, the reaction force (the counter force against the C direction) of the second flat wire torsion spring 9 acts on the distance piece 10, thereby decreasing the force of said flat wire torsion spring 4.

Further, the first flat spring 8 is provided so as to urge the lever member 6 in the b direction (see FIG. 1), said lever member 6 being provided to act integrally with the core bar 3 and not in relation to the rotation of the lid body 5. Accordingly, the energized force in the b direction acts on the lever member 6 within the whole rotation range of the lid body 5 (X, Y and Z areas), thereby energizing the rotation of the core bar through the lever member 6. Further, the first flat spring 8 is designed in relation to the spring torque of the flat wire torsion spring 4 with a spring force such that said spring torque may be higher than said spring torque within the operation range of the lid body 5, in the Y and Z areas, and be lower than said spring torque in the X area. Accordingly, in the closing process of the lid body 5 from its opening end point the spring torque of the flat wire torsion spring 4 rises along the dash and two-dotted line in FIG. 6 according to the rotation angle. In the Y and Z areas of this process, the spring force of the first flat spring 8 operates on the core bar 3 through the lever member 6 overcoming the spring torque of the flat wire torsion spring 4, said core bar 3 being urged and maintained in the condition shown with a dotted line in FIG. 4.

Figure 4:
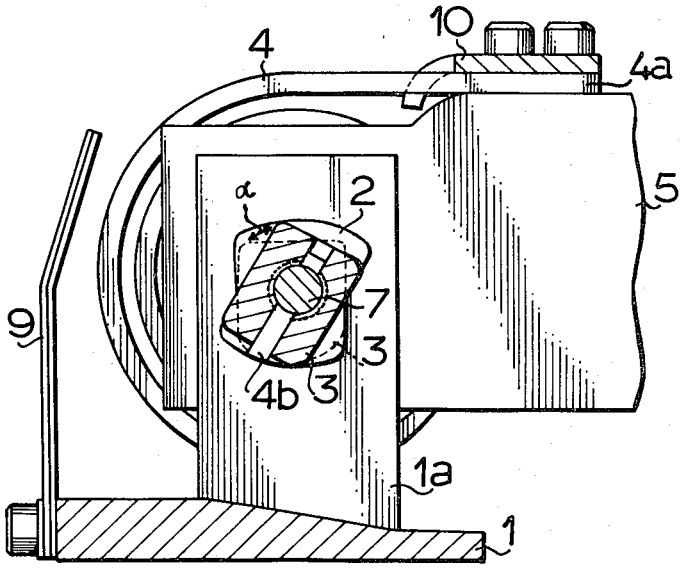

In other words, the state of the core bar 3 shown by dotted lines in FIG. 4, is that the bevelling portions, 3*a* and 3*b* of the core bar 3 are pressed on the hole wall of the perforated hole 2 as a result of energizing the rotation of the core bar 3 by the aid of the spring force of the first flat spring 8 through the lever member 6, thereby restricting the rotation of the core bar 3. Then, when the lid body 5 enters into the X area process, the spring torque of the flat wire torsion spring 4 operates on the core 3 overcoming the spring force of the first flat spring 8, and the core bar 3 rotates from the status of the dotted line to that of the solid line in FIG. 4 within the range of its degree of freedom. Since this rotation is in the same direction as the closing operation direction of the lid body 5, the increase of the spring torque in the flat wire torsion spring 4 corresponding to the rotation angle of the lid body 5 can be removed and the spring characteristic in the X area becomes a characteristic shown with a dash and two dotted lines $S_2$, in FIG. 6. Accordingly, even in the X area the spring characteristic can be approximated to the moment change M of the lid body 5.

Figure 6:
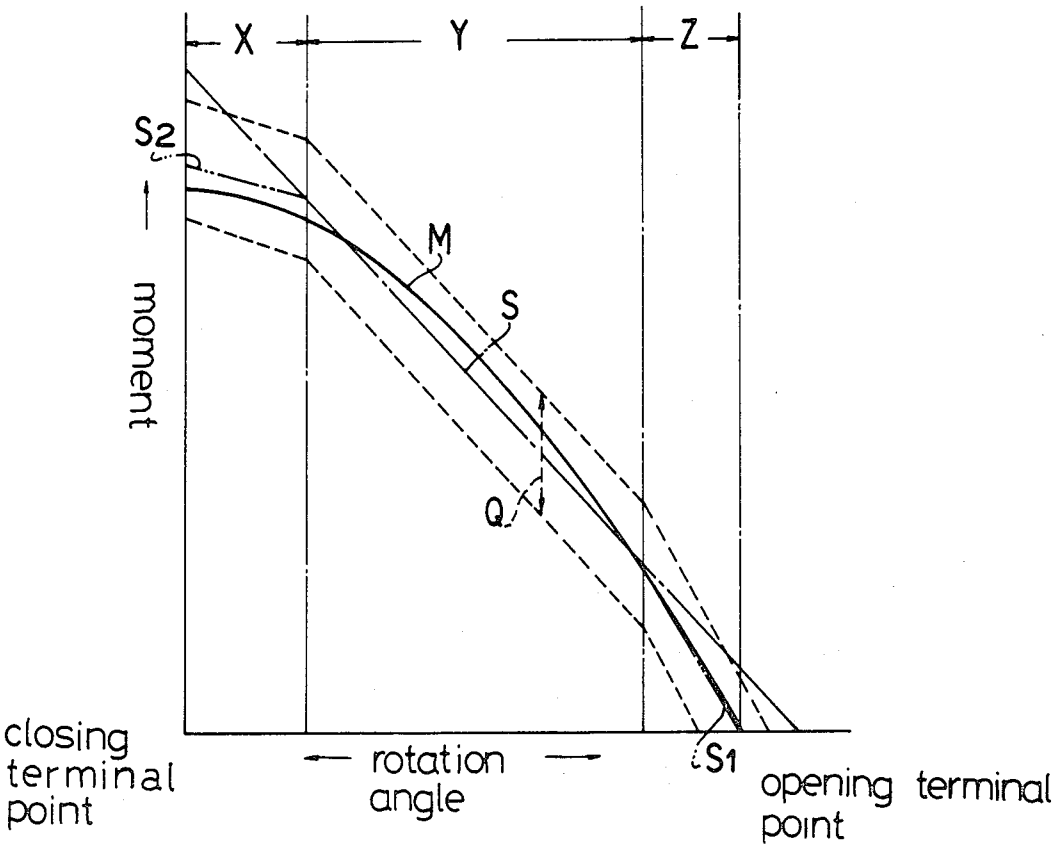
FIG. 6 is a graph which shows rotation moment and spring characteristic according to the change of a rotation angle of the rotation member.

The description mentioned above is an operating description from opening to closing of the lid body 5. Although, the operation from closing to opening is naturally the reverse operation thereof (the action of the core bar 3 is of course reversed), both of the spring characteristic and the moment change of the lid body 5 can also be approximated within the whole operation range of the lid body 5 the same as in the above description. Accordingly, in consideration of some friction during the rotation of said lid body 5, the lid body 5 can be allowed to stop at an arbitrary place within the whole operating range during opening and closing. Further, the numeral 11 in FIG. 2 is a belleville spring adapted to intervene between the erected plate 1*a* of the fixed member 1 and the outer wall of the lid body 5 into which the core bar 3 is inserted. The friction force during the rotative operation of the lid 5 can be suitably obtained by said belleville spring 11. Since the belleville spring 11 is conventionally made of hard material, it causes damage, wear and noise to the outer wall and the erected plate 1*a* when it is used as it is. Therefore, in order to remove such defects, it is desirable to use the belleville spring 11 covered with a resin such as a fluoric resin, a polyacetal resin, or the like. Further, the belleville spring 11 covered with the resin also has the advantage of providing a suitable friction force during the rotation of the lid body 5. The suitable friction force means such a friction force wherein the difference between the moment change M in the lid body 5 and the spring characteristic $S_1$-S-$S_2$, as shown in FIG. 6 is absorbed sufficiently and the lid body 5 can be rotated with an operating force as small as possible. For instance, when friction force Q shown by the dotted line in FIG. 6 is present during the rotation of the lid body 5, the difference between the moment shange M of the lid body 5 and the spring characteristic $S_1$-S-$S_2$, is sufficiently absorbed, and therefore the influence of this difference can be entirely ignored. For this reason, the lid body 5 can perform its rotative operation with a small operating force, and it is possible to stop the lid body 5 at any arbitrary position throughout the whole operating range during the opening or closing operation of the lid body 5. Further, the numeral 12 in FIG. 1 is a projection for presetting the flat spring 8, said projection 12 being formed integrally with 12*a*.

Figure 7:
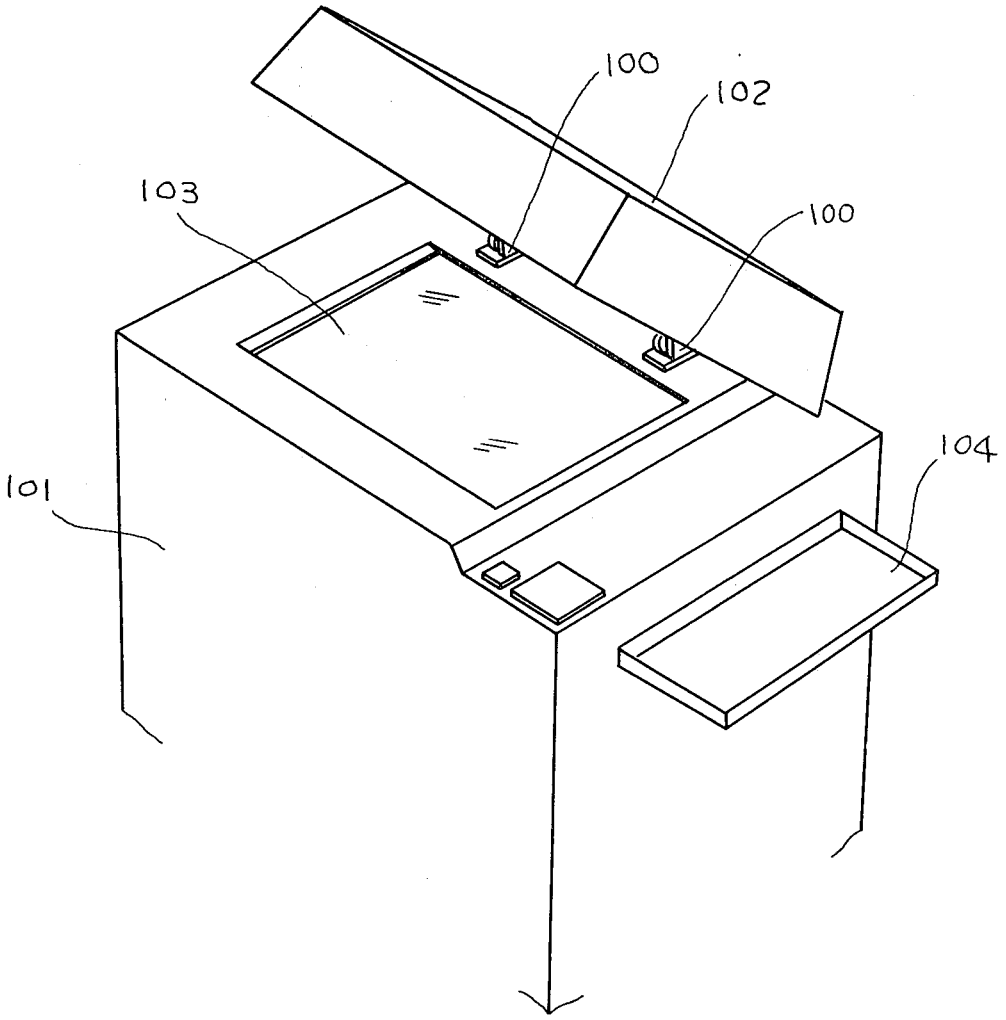
FIG. 7 shows one mode of use of this device.
Figure 8:
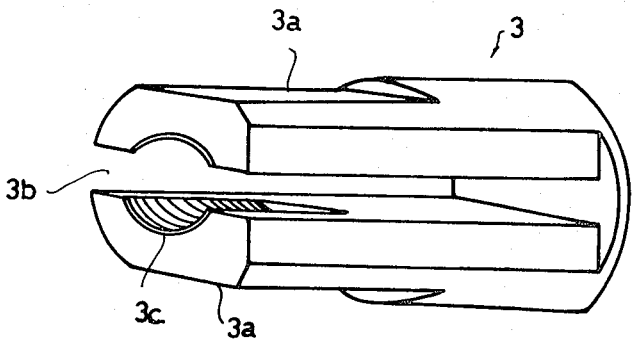
FIG. 8 is a perspective view of the FIG. 5 core bar.

Referring to the embodiment of the invention employed with a lid body of a duplicator as shown in FIG. 7, the numeral 101 is the main body of the duplicator and the numeral 102 is the lid body secured pivotably to the upper end of the duplicator 101 at one end thereof so as to open or close upward and downward. The hinge device 100 is pivotably carried on supporting portions of said lid body. Further, the numeral 103 is a manuscript stand glass and 104 is a tray of wasted manuscripts.

As is described above, in the hinge device of this invention, the spring characteristic is approximately equal to the rotational moment of the rotation member by means of the spiral spring and the first flat spring and/or the second flat spring. Accordingly, in case of the rotation of the rotation member, said rotation member can be allowed to stop at any arbitrary position within the range of operation, together with a smaller operating force, thereby possibly preventing such an accident as catching a workman's fingers or colliding with his foot due to the inertia of the rotation member. Therefore, it has significant practical effects. Further, according to the hinge device of this invention, since the combination in this invention is not a combination having a large size, but a combination having a small size including a flat member with a flat wire torsion spring, miniaturization of the whole device is possible. Accordingly, this invention also is advantageous in that there is no need of selecting a setting place for the device.

I claim:

1. A hinge device provided with:

a fixed member for fixing said hinge device to a fixed body, said fixed member having an apertured plate body; a core bar which supports a rotation member and which is rotatably inserted into said aperture having a deformed non-circular area provided in said plate body and having a wall portion so as to have a suitable degree of rotative freedom to vary the rotation moment of said rotation member in accordance with an angle of rotation;

a flat wire torsion spring having a substantially spiral shape and fixed at the inner end thereof to said core bar and the outer end thereof to said rotation member, respectively;

a lever member fixed to one end of said core bar;

a first flat spring fixed to said fixed member and in abutting relationship to said lever member to bias said core bar in a rotational direction through said lever member, thereby rotationally urging said core bar toward said wall of said aperture in said plate body;

a second flat spring fixed at one end to said fixed member and having its other end extending therefrom in abutting relationship to said rotation member at the point where the rotational moment thereof is minimum and operating to counteract the spring force of said flat wire torsion spring; the torque of said flat wire torsion spring having a spring force more than that of said first flat spring and adapted to revolve said core bar in a direction opposite to the rotational direction of said first flat spring acting on said lever member and within a range of motion up to the maximum rotation moment, and the difference between the combined spring characteristic of said first and second flat springs, said flat wire torsion spring, and said rotation member, is such as to be within a range wherein said difference can be absorbed by the rotative friction of said rotation member.

2. A hinge device in accordance with claim 1 which comprises increasing the rotative friction of said rotation member by suitably intervening an elastic member as a spring or the like between the supporting portion of the rotation member and the fixed member.

* * * * *